US010765926B2

(12) United States Patent
Hauge

(10) Patent No.: US 10,765,926 B2
(45) Date of Patent: Sep. 8, 2020

(54) GOLF PUTTER ALIGNMENT SYSTEM

(71) Applicant: Melvin Arnold Hauge, Buckley, WA (US)

(72) Inventor: Melvin Arnold Hauge, Buckley, WA (US)

( * ) Notice: Subject to any disclaimer, the term of this patent is extended or adjusted under 35 U.S.C. 154(b) by 0 days.

(21) Appl. No.: 16/139,732

(22) Filed: Sep. 24, 2018

(65) Prior Publication Data

US 2020/0197779 A1 Jun. 25, 2020

Related U.S. Application Data

(60) Provisional application No. 62/618,771, filed on Jan. 18, 2018.

(51) Int. Cl.
*A63B 69/36* (2006.01)
*A63B 53/04* (2015.01)

(52) U.S. Cl.
CPC ..... *A63B 69/3685* (2013.01); *A63B 2209/00* (2013.01)

(58) Field of Classification Search
CPC ..... A63B 69/3685; A63B 2209/00; A63B 53/0487; A63B 2053/0441; A63B 69/3632; A63B 53/04; A63B 53/065; A63B 53/007; A63B 2071/0694; A63B 69/3676; A63B 43/008; A63B 69/3641
USPC ..... 473/220, 226, 251–255, 334–336, 340, 473/341
See application file for complete search history.

(56) References Cited

U.S. PATENT DOCUMENTS 3,333,854 A * 8/1967 White ..... A63B 53/0487 473/288
D228,563 S * 10/1973 Brower ..... D21/744
3,880,430 A * 4/1975 McCabe ..... A63B 69/3685 473/253
4,209,172 A * 6/1980 Yamamoto ..... A63B 69/3685 473/200
4,629,193 A * 12/1986 Pierman ..... A63B 69/3685 473/254
4,913,438 A * 4/1990 Anderson ..... A63B 53/04 473/253
4,962,931 A * 10/1990 Jazdzyk, Jr. ..... A63B 53/0487 473/252
5,288,080 A * 2/1994 Tice ..... A63B 69/3614 473/220
5,746,664 A * 5/1998 Reynolds, Jr. ..... A63B 53/02 473/252
7,108,613 B1 * 9/2006 Gordon ..... A63B 53/0487 473/341

(Continued)

*Primary Examiner* — Nini F Legesse
(74) *Attorney, Agent, or Firm* — Haynsworth Sinkler Boyd, P.A.

(57) ABSTRACT

A golf putter alignment system has two alignment markers placed above the strike face of a putter head on the front top surface of the putter head. The alignment markers are centered about a midpoint that corresponds to the horizontal center of the strike face, with the distance between the centers of the alignment markers corresponding to the diameter of a golf ball. The alignment markers can be mounted on top of or integrally with the putter head to provide visual alignment markers on the front top surface. The alignment markers are formed from several materials with colors that contrast with the color of the front top surface.

20 Claims, 4 Drawing Sheets

(56) References Cited

U.S. PATENT DOCUMENTS

| | | | | |
|---|---|---|---|---|
| 7,156,752 | B1 * | 1/2007 | Bennett | A63B 53/02 473/334 |
| 7,918,745 | B2 * | 4/2011 | Morris | A63B 53/0487 473/252 |
| 2007/0004524 | A1 * | 1/2007 | Harrison | A63B 69/3685 473/238 |
| 2009/0017933 | A1 * | 1/2009 | Stites | A63B 53/007 473/254 |

* cited by examiner

GOLF PUTTER ALIGNMENT SYSTEM

This application claims the benefit of U.S. Provisional Application No. 62/618,771 filed Jan. 18, 2018.

FIELD OF THE INVENTION

The invention relates to a golf putter alignment aid for improving golf putting accuracy.

BACKGROUND OF THE INVENTION

Putting is a key aspect in golf. Individual holes in golf are rated as either par 3, 4 or 5, with each hole par standard accounting for taking two putting strokes. Accordingly, an 18-hole round of golf ideally requires about 36 putts per round. Golfers ranging from recreational golfers to low handicap or scratch golfers, even professional golfers, can often struggle to have on average 2 putts or less per hole, and thereby struggle to have 36 or less putts per 18-hole round of golf. Statistics from the United States Golf Association (USGA) USGA state that the average male golfer shoots a 98-99 and has at least 40 putts per round or 2.2 putts per hole (https://18birdies.com/clubhouse/golf-instruction/putting-by-the-numbers/; site visited Sep. 14, 2018).

There are many styles of putters, including blades, mallets, heel-toe weighted, and T-line putters. Typically, there are putting alignment aids on the top surface of golf putters to help golfers putt a ball on a correct line (as read by the golfer on a putting green) that will result in holing a putt. One common alignment aid is a straight line, parallel lines that are etched and/or painted on the top surface of the putter and run perpendicular to the putter hitting or striking face. Likewise, there are alignment aids that are a series of dots or circles (instead of lines) on the top surface of the putter and run perpendicular to the putter face. Another common alignment aid is a T-shape on the top surface of the putter, in which a line perpendicular to the putter face intersects a line parallel to the putter face, to form a T shape. Yet another alignment aid on the top of mallet putters is an alignment of two balls perpendicular to the putter face.

Despite the numerous types of golf putter alignment aids, golfers of all levels, especially recreational and golfers having mid to high handicaps still struggle to align putts and average 2 or less putts per hole in a round of golf. Thus, there remains a need in the art for a golf putter alignment system that will help golfers improve their putting alignment and accuracy. The present invention provides such a desirable golf putter alignment system.

SUMMARY OF THE INVENTION

A golf putter alignment system is provided herein. The alignment system comprises a putter having a putter head in which two alignment markers are strategically placed on the top surface of the putter head above the ball striking face of the putter to aid a golfer in aligning the putter for improved putting accuracy.

The alignment markers are located toward opposite ends of the front top surface of a putter head, equidistantly spaced from the midpoint of the front top surface that aligns with the horizontal center or so called "sweet spot" of the putter strike force. The distance between the markers or dots is approximately the diameter of a golf ball, or approximately 1.68 inches.

The alignment markers are formed of colors that contrast with the color of the front top surface of the putter head to visually stand out when viewed overhead by a golfer in an address position in which the putter face is aligned against a golf ball. The alignment markers may also be formed from light reflective materials, such as crystalline small pieces of glass or diamonds.

The alignment markers are preferably circles or dots that are either mounted on the front top surface of the putter head or are integrally formed in the putter head. Integrally formed or placed alignment markers have structures that extend into a front portion of the putter head, below the front top surface of the putter, and are held in place by receiving members in the putter head. The circular tops of the integrally formed alignment markers typically are level or nearly so with front top surface of the putter head.

The alignment markers disclosed herein are preferably removable, allowing the alignment markers to be replaced if worn or damaged. Likewise, the markers can be replaced by markers of different colors, to provide a golfer with different options for the color of the alignment markers.

In a preferred embodiment, the alignment markers are made of light emitting material, such as fiber optics. In this embodiment, the light emitting ends of fiber optics are held in receiving members at or below the front top surface of the putter head, such that the light emitting ends align with or are recessed with the front top surface. The light capturing surfaces of the fiber optics are positioned within the putter head for exposure to ambient light.

In one embodiment of fiber optic alignment markers, the markers are formed of two individual fiber optics that are vertically aligned within the putter head. The light emitting ends are positioned through receiving members in the front top surface, while the opposite ends are positioned in receiving members toward the bottom of the putter head. The light capturing surfaces of the fiber optics are preferably exposed to ambient light through openings or windows located through the putter head between the top and bottom receiving members. The light capturing surfaces of the fiber optics accordingly are positioned within the openings in the putter head.

In an alternative embodiment of fiber optic alignment markers, the markers are formed from a single, continuous fiber optic in which the two light emitting ends of the fiber optic are held in receiving members to form the alignment markers in the top surface of the putter head. The light capturing surfaces of the fiber optic are held in a channel that faces the rear of the putter below the top front surface to expose the fiber optic to ambient light. In a preferred embodiment, the light capturing surfaces of the fiber optic are held in the channel by a clear plastic cover that attaches to the putter head.

The fiber optic alignment markers are preferably removable to allow replacement if they become worn or damaged, or to allow fiber optics of different colors to be interchangeably used as the alignment markers.

DETAILED DESCRIPTION OF THE INVENTION

Figure 1:
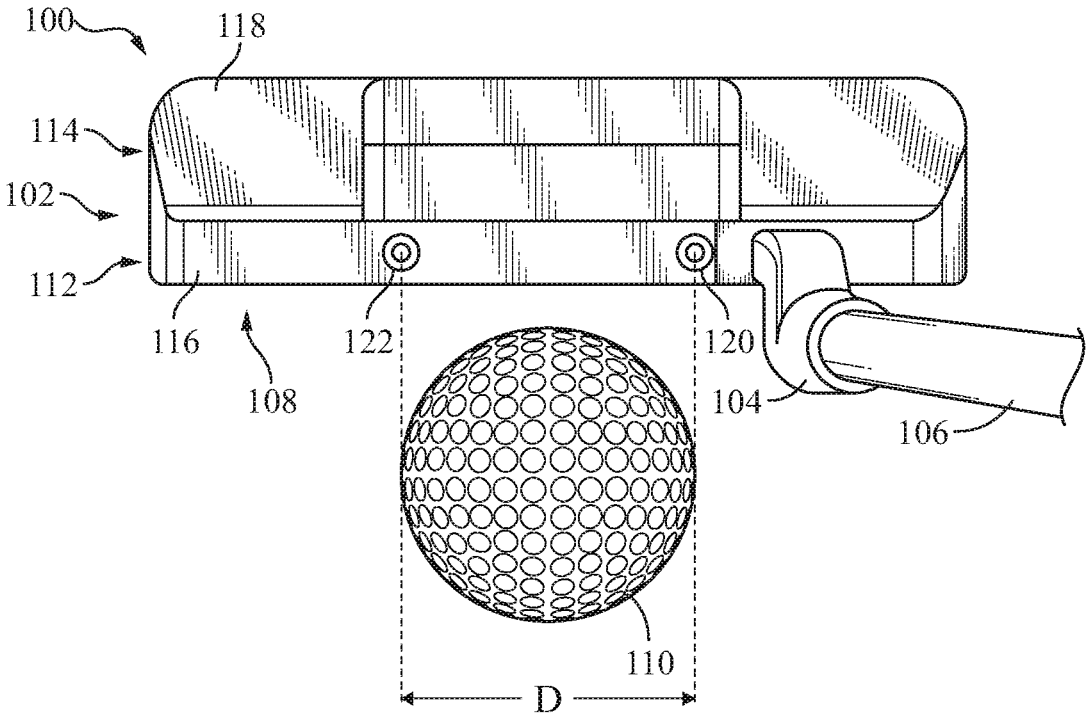
FIG. 1 shows an overhead view of an embodiment of the presently disclosed golf putter alignment system.

The present invention relates to a golf putter alignment system. The system comprises two markers placed on the top of a putter such that the markers are visible to a golfer holding the putter down at address on the putting surface and aligning the putter for a putt. The markers work alone or in conjunction with other typical alignment markers on the top of the putter, such as a straight line(s), T-markers, a series of small, straight circles in a line, two white circles representing balls arranged in a straight line, and so on.

The presently disclosed putter alignment system and markers may be used on virtually any form of putter including, but not limited to, blade, mallet, heel-toe weighted, and T-line putters.

The putter alignment system presently disclosed preferably employs markers comprising two circular dots on the top of the putter head that are placed at or near the front edge of the top of the putter head above the putter ball striking face, toward the golf ball and the target line and/or hole. Alternatively, the markers may be triangular, rectangular, trapezoid/diamond, rhombus, or any of many different shapes.

The presently disclosed putter alignment system accordingly provides for use of dual alignment aids, typically dots or circles, that assist the golfer in setting the putter face at a 90-degree angle to the target line. Advantageously, a golfer looking at the dual alignment aids and the intended target will be inclined to naturally set the putter face correctly behind the ball. Additionally, a golfer typically will naturally find the center position between the alignment aids and position the putter to promote swings in which the center of the club face strikes the ball, thereby reducing off-center shots. The presently disclosed alignment aids thereby facilitate and ease alignment of the putter face by a golfer, given the natural tendency to both set the dual alignment aids perpendicular to the target and center the ball between the alignment aids.

The markers of the alignment system are preferably placed at a distance such that the center of the markers align with the outer edge/diameter of a golf ball. A standard golf ball has a diameter not less than 1.68 inches, as specified by the official rules of golf governed by the United States Golf Association and The Royal and Ancient Golf Club. Accordingly, the centers of the markers are preferably placed 1.68 inches or about 1.68 inches apart. Alternatively, they may be placed such that the edges of the markers align to be just inside or outside the width of the ball. Thus, the markers preferably will range in distance apart from the inner edges of the markers being about 1.68 inches apart; the center of the markers being about 1.68 inches apart, or the outer edges of the markers being about 1.68 inches apart.

The markers can be painted and/or etched onto the putter head, can be separate pieces that are affixed to the head, and so forth. In one embodiment, the markers are circular dots. The dots can be a solid, consistent color across the dots. Alternatively, the dots can be concentric circles which have an inner dot or circle surrounded by an outer circumference circle or ring. In one embodiment, the two circles have different colors. In this scenario, a dot could have a solid, lighter-colored inner circle circumferentially surrounded by a darker-colored outer circle, or vice versa. For example, the dots might be white inner circles surrounded by black outer circumference circles. Alternatively, the exemplary dots might be black inner circles surrounded by white outer circumference circles. In a preferred embodiment, the circumference of the inner dot continuously contacts the inner circumference of the outer circle. In an alternatively preferred embodiment, the circumference of the inner dot does not contact the inner circumference of the outer circle or ring, such that there is a gap between the inner circle and outer circle.

In an alternative embodiment, the circular markers are formed from circular lines that are not filled in with a color, such that that the alignment markers can be formed of a single ring, concentric circles that form a ring within a ring, and so forth.

In a preferred embodiment in which the alignment aids or markers are circular dots, the dots preferably have a diameter that ranges from about 3 mm to about 15 mm. In another preferred embodiment in which the circular dots comprise concentric circles, the inner circle preferably has a diameter that ranges from about 1 mm to about 13 mm, while the outer circle preferably has an outer diameter that ranges from 3 mm to about 15 mm. In this regard, the inner circle would fit inside the outer circle.

The alignment aids can be composed of virtually any color that provides a contrast to the top surface of the putter, such that the alignment aids are visible to the golfer. For example, a dark putter surface can by complemented with alignment aids that have lighter color shades. In contrast, a lighter putter surface can by complemented with alignment aids that have a different lighter color shade or a darker color shade.

In a preferred embodiment, the alignment aids or markers are light reflecting. The alignment aid can be any reflective material, such as, but not limited to, a reflective paint. Alternatively, the reflective material can be a light reflective, crystalline material. Such materials include, but are not limited to, glass pieces, diamond pieces, etc. In one embodiment, the alignment aids are light reflecting circles or dots. In a preferred embodiment, the alignment aids are circles or dots having an outer circumference circle and a light reflecting inner, solid circle. The circumference preferably will have a color or shade that provides contrast to the light reflecting inner circle.

In another embodiment, the markers are removable, such that they can be replaced or interchanged with alternative markers of varying colors, etc. In a preferred embodiment, the markers are recessed into the putter head, such that the top surface of the marker is flush with the putter head top surface or is either recessed or raised relative to the putter head top surface.

In one preferred embodiment, the alignment aids are made of light reflecting fiber optics. Ambient light is captured and channeled through the use of fiber optics. This captured light and is directed to the top surface of the putter where it is emitted up toward the golfer. In one embodiment, the fiber optics are positioned such that they capture light by being exposed to ambient light behind the putter face. The putter face itself can also have holes, slots or windows in the putter face that allow ambient light from the front of the putter face to pass through the putter face and be captured by the fiber optics. Thus, the fiber optics can capture ambient light from behind the putter face, in front of the putter face, or a combination of both behind and in front of the putter face.

Fiber optics can be chosen to emit any of a number of different colors of light. Such colors include, but are not limited to, white, yellow, orange, red, blue, green, violet, and virtually any combination of such colors. Fiber optics for use in the alignment aids can be made of any appropriate material that will capture ambient light and emit it at the end of the fiber optic. Examples of fiber optics include, but are not limited to, those commercially available as TRUGLO® fibers (TRUGLO Inc., Richardson, Tex.), and optical acrylic rods comprised of fiber having a core of polystyrene containing fluorescent dyes surrounded by a clear acrylic cladding.

The fiber optics preferably are mounted in the putter head in a manner where they are removable and thereby allow replacement of the fiber optics. Accordingly, fiber optics of different colors can be interchangeably placed into a given putter head. Moreover, fiber optics that wear out over time and gradually lose their ability to emit light can be replaced.

Turning now to the Figures, various embodiments of the presently disclosed putter alignment system are shown. FIG. 1 shows a putter alignment system from an overhead view of a heel-toe weighted blade putter 100. The putter 100 has a putter head 102 that is connected by a hosel 104 to a putter shaft 106. The putter head 102 has a forward-facing vertical, flat ball-striking face/surface 108 that faces a golf ball 110 at address. The putter head 102 has a front portion 112 and a rear portion 114 that extends back from the front portion 112. In the embodiment shown, the putter head front portion 112 has a height greater than that of the rear portion 114, such that the rear portion 114 extends away from and below the front portion 112. The front portion 112 has a front top surface 116 that is immediately adjacent to the strike face 108, such that the front top surface 116 forms an approximately 90-degree angle with the strike face 108 in the putter embodiment 100 shown in FIG. 1. The rear portion 114 of the blade putter depicted in FIG. 1 has a rear top surface 118. Accordingly, when the putter head 102 is viewed from above by a golfer at address, the golfer sees the front top 116 and rear top 118 surfaces of the putter head 102, as shown in FIG. 1.

The front top surface 116 of the putter head 102 has two alignment aids or markers (120, 122) positioned on the top surface. The alignment markers 120 and 122 are preferably spaced apart and positioned to align with the width or diameter D of a golf ball 110, which is 1.68 inches or approximately 1.68 inches. Thus, at address, a golfer can align the putter head 102 to the golf ball 110 by aligning the alignment markers 120 and 122 with the diameter of the golf ball 110. The markers 120 and 122 are likewise equidistantly spaced or positioned from the horizontal center of the strike face 108, such that the midpoint of the distance between the markers 120 and 122 on the horizontal front top surface 116 aligns with the horizontal center of the strike face 108. The markers 120 and 122 therefore enable a golfer to align or frame the center of the strike face 108 with the center of the golf ball 110 to promote striking the ball on line by a golfer's putting stroke.

In the embodiment shown in FIG. 1, the alignment markers 120 and 122 are each composed of two concentric circles that form a circular marker or dot. Each of the inner and outer circles of the alignment markers 120 and 122 have the same diameters with respect to those of the other marker. As shown, the dots 120 and 122 are preferably positioned and spaced apart such that the centers of the dots 120 and 122 align with the diameter of a golf ball 110. The positioning of the markers 120 and 122 is not limited to this spacing, and can be positioned such the centers, inner edges, or outer edges, or any variation thereof aligns with the diameter of the golf ball 110. Alternatively, the markers 120 and 122 can be positioned such that the distance between the markers is less than or greater than the diameter of a golf ball.

The alignment markers 120 and 122 in FIG. 1 are shown in a preferred embodiment in which the forward/aft position of the centers of the markers 120 and 122 on the top face surface 116 align with the midpoint of the width of the front top surface 116. The markers 120 and 122 are therefore centered between the front and rear edges of the front top surface 116. Alternatively, the markers may be placed such that they are closer to or further away from the front edge of the front top surface 116, and therefore align more closely with the front or rear edges of the front top surface 116. While the alignment markers 120 and 122 as shown have equally sized diameters that are smaller than the width of the front top surface 116, the alignment markers 120 and 122 alternatively could have diameters that are equal in size to the width of the front top surface 116. In this regard, the alignment markers 120 and 122 would be centered within the front top surface 116 and extend from the front edge to the rear edge of the front top surface 116.

The size of the alignment markers 120 and 122 can vary widely within the size constraints of the width of the front top surface 116. For example, circular or dot alignment markers can vary in diameter from, but not be limited to, approximately 1 mm to 20 mm, or any subset thereof, such as 3 to 15 mm, 4 to 13 mm, etc.

The alignment markers may be in any desired color. The alignment markers preferably are made of colors that contrast or highly contrast with the color of the putter head 102, and, in particular, the color of the front top surface 116. For example, if the front top surface 116 of the putter head 102 is made of a darker color, the alignment markers can be made of a contrasting bright color, such as bright, luminous white or luminous or fluorescent "highlighter" type colors, for example, yellow, red, pink, purple, orange, blue, green, etc. Likewise, the alignment markers can be made of darker color to contrast with a lighter colored front top surface 116 of the putter head 102. Moreover, the alignment markers can be made of a reflective material that would reflect ambient light. For example, the alignment markets can be made of a crystalline, reflective material such as small glass particles that are adhered to the front top 116 of the putter head 102 by a cement or adhesive.

In the embodiment shown in FIG. 1, the alignment markers 120 and 122 are concentric circles. The colors and presentations of these concentric circles can widely vary, as desired. For example, the inner circle or dot and the outer circle between the concentric circles can be of different colors, such that the inner circle or dot has a different or contrasting color to the outer circle formed between the inner and outer concentric circles. One example of such a configuration might be in a putter head having a silver or aluminum background coloration, the alignment markers 120 and 122 could have a black outer circle with a white inner circle. In an alternative embodiment, the concentric circles could be drawn as colored lines without a fill color between the inner and outer circles and/or within the inner circle each marker. In this scenario, the colored lines would contrast with the background color of the front top surface 116.

While the embodiment of the alignment markers 120 and 122 in FIG. 1 are depicted as concentric circles, the markers can take the form of any desired shape, including single circles or dots that are either a solid color or a circular line. While the markers preferably are circles or circular shaped, the markers alternatively can be squares, rectangles, diamonds, triangles, rhombuses, lines, arrows, T-shaped lines, and so forth. In whatever form or shape the markers take, they preferably are positioned on the top surface of the putter head such that the centers/middles, inner or outer edges, and any variations thereof align with the diameter of a golf ball. The sizes of alignment markers can likewise vary in width and/or length. For example, various alignment marker shapes can have widths or lengths that vary from, but not be limited to, approximately 1 mm to 20 mm, or any subset thereof, such as 3 to 15 mm, 4 to 13 mm, etc.

The alignment markers 120 and 122 as presently disclosed may be provided on or formed with the putter head 102 in any desired manner, and therefore may be attached to the front top surface 116 or integrally formed in the front top surface 116. For example, if desired, the alignment markers 120 and 122 may be attached as stickers that adhere to the front top surface 116 by an adhesive or cement. Likewise, the alignment markers 120 and 122 may be painted on the front top surface 116 of the putter head 102. While alignment markers 120 and 122 that adhere to the front top surface 116 are preferably flat and therefore are nearly level with the front top surface 116, the alignments markers 120 and 122 alternatively can have a thick or raised profile, such that the alignment markers 120 and 122 have a profile that sits above or protrudes from the flat front top surface 116. Alignment markers 120 and 122 that are adhered to the front top surface 116 could be made from any applicable material, such as plastic, metal, etc. Furthermore, the alignment markers 120 and 122 can be made from a light reflective or crystalline material, such as small glass particles.

Figure 2:
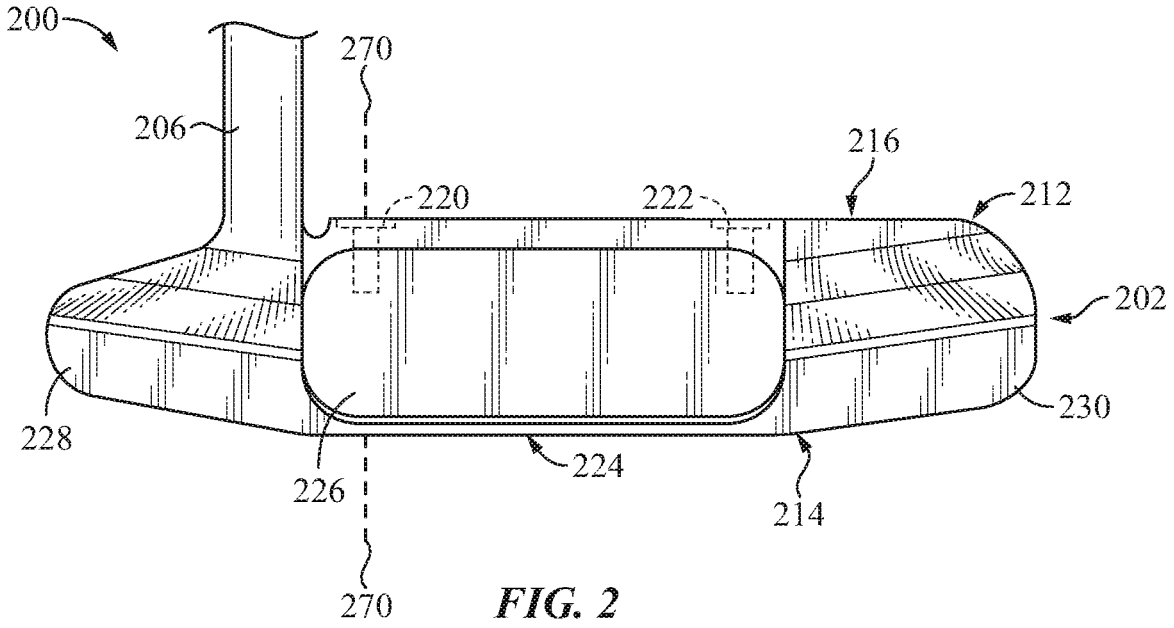
FIG. 2 shows a rear perspective view of an embodiment of the presently disclosed golf putter alignment system in which the alignment markers are integrally formed in a putter head.

In an alternative preferred embodiment, the alignment markers may be integrally placed or formed within the front portion of the putter head. An exemplary embodiment in which the alignment markers are integrally formed or placed in the front top surface of the putter head is shown in FIG. 2. The putter 200 depicted in FIG. 2 is a blade, heel-toe weighted putter similar to the putter 100 shown in FIG. 1, with the putter 200 being viewed from behind the putter head 202, which is attached to the putter shaft 206. The putter head 202 has a front portion 212 and a rear portion 214 that extends away from and below the front portion 212. The front 212 and rear 214 portions are continuous with the bottom surface or sole 224 of the putter head 202. The front portion 212 has a front top surface 216 that is immediately adjacent to the strike face 208 (not shown in FIG. 2 but visible in FIG. 3). The rear portion 214 of the blade putter depicted in FIG. 2 has a rear top surface 218. The rear portion 214 also has a cavity back 226 that sits between the heel 228 and toe 230 of the putter head. When the putter head 202 is viewed from above by a golfer at address, the golfer sees the front top 216 and rear top 218 surfaces of the putter head 202.

In this embodiment, the putter 200 has a putter head 202 that has a flat front top surface 216 similar to that of the putter depicted in FIG. 1. The putter head 202 has two alignment aids or markers 220 and 222 that are integrally formed with the putter head 202, such that the alignment markers 220 and 222 are fit into the front portion 212 of the putter head 202. In the embodiment shown in FIG. 2, the tops of the alignment markers 220 and 222 are level with the flat, front top surface 216 of the putter head 202, such that the entire front top surface 216, inclusive of the alignment markers 220 and 222, is flat. Alternatively, the alignment markers 220 and 222 could protrude above or be recessed within the front top surface 216 of the putter head 202. Accordingly, alignment markers that are integrally placed or formed in the front portion 212 of a putter head 202 may extend above the front top surface 216, be level or flush with the front top surface 216, or be recessed/below the front top surface 216. Typically, the front top surface 216 will be a horizontal, flat surface when the putter is held upright in an address position. Alternatively, the front top surface 216 can be curved, such that is it convex or concave.

The alignment markers 220 and 222 as shown in FIG. 2 have circular tops, such that they appear as circles when viewed from above by a golfer at address. The alignment markers 220 and 222 are positioned such that the centers of the circular alignment markers 220 and 222 align with the diameter of a golf ball, similar to the spacing of the alignment markers shown in FIG. 1. The position of the alignment markers 220 and 222 can vary, such that the inner edges, centers, or outer edges of the alignment markers 220 and 222 may align with the diameter of a golf ball. As per the markers 120 and 122 shown in FIG. 1, the alignment markers 220 and 222 are likewise equidistantly spaced or positioned from the center of the strike face, such that the midpoint of the distance between the markers 220 and 222 on the horizontal front top surface 216 aligns with the horizontal center or sweet spot of the strike face 208.

As described above for the alignment markers 120 and 122 shown in FIG. 1, the alignment markers 220 and 222 shown in FIG. 2 are not limited to being circular in shape. Accordingly, integrally placed or formed alignment markers can alternatively be of any desired shape, such as be squares, rectangles, diamonds, triangles, rhombuses, lines, arrows, T-shaped lines, and so forth.

Figure 3:
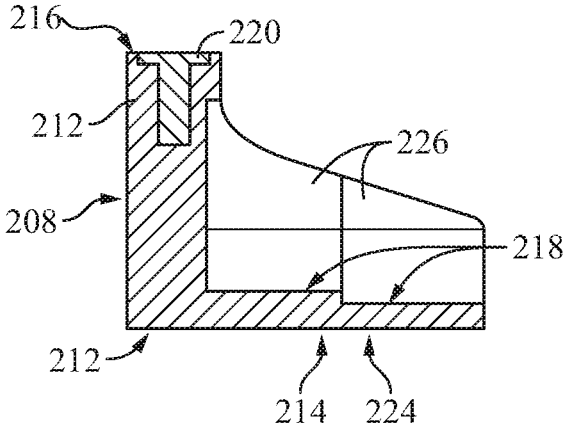
FIG. 3 shows a cut away view of the putter shown in FIG. 2.

A cut away view of the putter head 202 shown in FIG. 2 is shown in FIG. 3. The cut away portion shown in FIG. 3 corresponds with the dotted lines 270 shown in FIG. 2. The alignment markers 220 and 222 shown in FIGS. 2 and 3 have diameters that are smaller than the width of the front top surface 216. As represented by alignment marker 220 shown in FIG. 3, the fore/aft position of the centers of the alignment markers 220 and 222 on the front top surface 216 are centered between the front and rear edges of the front top surface 216. Alternatively, the alignment markers 220 and 222 could be positioned closer to the front edge or rear edge of the front top surface 216. Furthermore, the alignment markers 220 and 222 could have diameters that are equal in size to the width of the front top surface 216, whereby the alignment markers 220 and 222 would be centered within the front top surface 216 and visually reach from the front edge to the rear edge of the front top surface 216.

As described above for circular alignment markers, such as those exemplified by alignment markers 120 and 122 (FIG. 1), the size of the alignment markers 220 and 222 can vary widely within the size constraints of the width of the front top surface 216. For example, circular or dot alignment markers can vary in diameter from, but not be limited to, approximately 2 mm to 20 mm, or any subset thereof, such as 3 to 15 mm, 4 to 13 mm, etc. The widths and lengths of alternatively shaped alignment markers can likewise vary along the lines of these sizes.

In the exemplary embodiment shown in FIGS. 2 and 3, the integrally formed, circular alignment markers 220 and 222 have a side profile T-shape that fits into a matching T-shape recess or receiving member within the front portion 212 of the putter head 202. The alignment markers 220 and 222 accordingly may be regarded as circle-topped hubs that fit into the front portion 212 of the putter head 202. Each of the alignment markers 220 and 220 can be fit into the recess or receiving member in the front portion 212 of the putter head 202 in any of several ways, such by being press fit, using mechanical connectors, cements or adhesives, fusing techniques, etc. In an alternative embodiment, the integrally formed alignment markers 220 and 222 can be threaded to align with complementary threads in the front portion 212 of the putter head 202, such that the alignments markers 220 and 222 can be screwed into the front portion 212.

If desired, the alignment markers 220 and 222 may be removable, so that they can be replaced if they become worn or damaged, or replaced by another alignment marker of a different color. In the embodiment where the alignment markers 220 and 222 are either press fit or threaded into the front portion 212 of the putter head 202, the alignment markers can be configured to be readily inserted into or removed from the putter head 202. In this regard, the alignment markers 220 and 222 could be configured to be removable with tools such as a screwdriver, wrench, hex key, a specialized tool designed to insert/remove the alignment markers 220 and 222, etc.

The alignment markers 220 and 222 may be made of any of several materials, such as plastic, metal, etc. The tops of the alignment markers 220 and 222 may also contain a light reflective or crystalline material, such as small glass particles.

The alignment markers 220 and 222 are circular and have a T-shaped profile that fits into a matching, receiving member profile that is formed in the front portion 212 of the putter head 202. This exemplary embodiment does not limit the size or shape of the separate alignment marker that is integrally formed with the front portion 212 of the putter head 202. Accordingly, the integrally formed alignment marker can have any shape or form that would be applicable for integrally placing the alignment marker into the front portion 212 of the putter head 202. As described above, the alignment marker can be made of any of several applicable materials (e.g., plastic, metal, etc.) that fit into a recess or is otherwise attached to the putter head 202. Likewise, an alignment marker can be attached by any of several applicable ways to secure the alignment marker with the front portion 212 of the putter head 202, and the alignment marker can also be removable.

The alignment markers 220 and 222 will preferably have a color that contrasts with the color of the front top surface 216. As described above for alignment markers in general, the alignment markers 220 and 222 can be any of a wide range of colors that contrast with the color of the front top surface 216 of the putter head 202.

In the embodiments described above and shown in FIGS. 1-3, the alignment markers can be made of any of several applicable materials, such as plastic, metal, various reflective materials such as glass particles, and so on. Alternatively, in a preferred embodiment the alignment markers are made from a light emitting material, such as fiber optic materials, tritium materials, and the like. Preferably, the light emitting material is fiber optics, such that the fiber optics capture ambient light and transmit it to the front top surface of the putter head.

Figure 4:
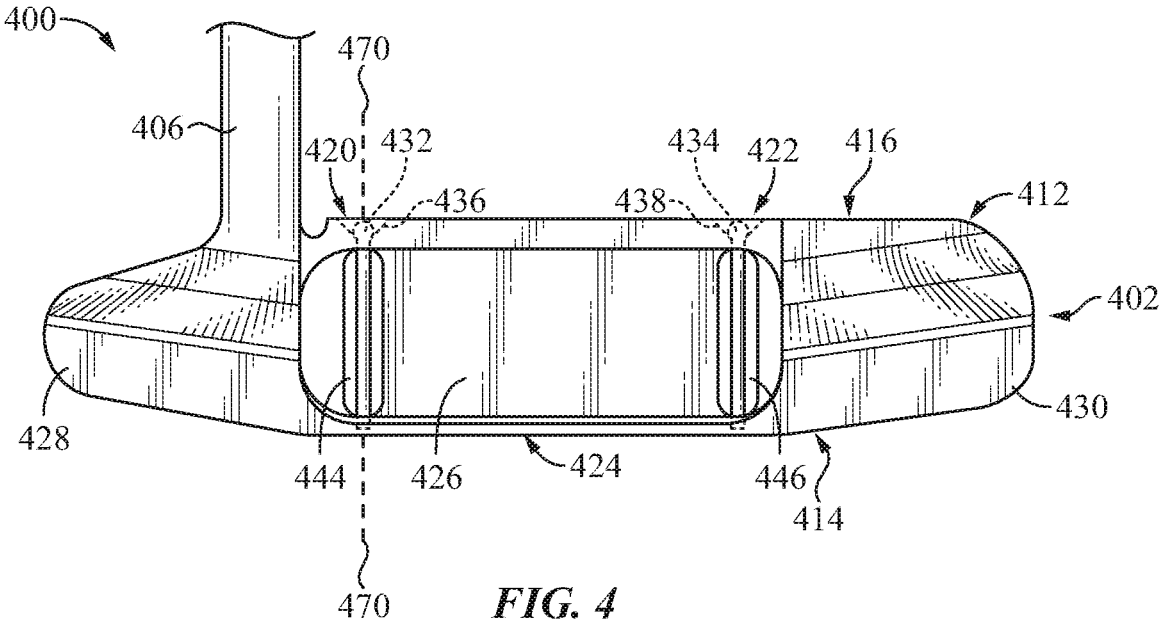
FIG. 4 shows a rear perspective view of an embodiment of the presently disclosed golf putter alignment system in which the alignment markers are fiber optics.

An exemplary embodiment in which the alignment markers are formed from fiber optics is shown in FIG. 4. The putter 400 depicted in FIG. 2 is a blade, heel-toe weighted putter similar to the putters 100 and 200 shown in FIGS. 1 and 2. The putter 400 is shown from behind the putter head 402, which is attached to the putter shaft 406. The putter head 402 has a front portion 412 and a rear portion 414 that extends away from and below the front portion 412. The front 412 and rear 414 portions are continuous with the bottom surface or sole 424 of the putter head 402. The front portion 412 has a front top surface 416 that is immediately adjacent to the strike face 408 (not shown in FIG. 4, but visible in FIG. 5). The rear portion 414 of the blade putter depicted in FIG. 4 has a rear top surface 418. The rear portion 414 also has a cavity back 426 that sits between the heel 428 and toe 430 of the putter head. When the putter head 402 is viewed from above by a golfer at address, the golfer sees the front top 416 and rear top 418 surfaces of the putter head 402.

In this embodiment, the putter 400 has a putter head 402 that has a flat, front top surface 416 similar to those of the putters depicted in FIGS. 1 and 2. The putter head 402 has two alignment aids or markers 420 and 422 composed of fiber optics that are integrally fit into the putter head 402, such that the alignment markers 420 and 422 are fit into the front portion 412 of the putter head 402. In the embodiment shown in FIG. 4, the tops of the alignment markers 420 and 422 are level or nearly so with the flat, front top surface 416 of the putter head 402. Alternatively, the alignment markers 420 and 422 could protrude above or be recessed within the front top surface 416 of the putter head 402. Accordingly, fiber optic alignment markers that are integrally formed in the front portion 412 of a putter head 402 may extend above the front top surface 416, be level or flush with the front top surface 416, or be recessed/below the front top surface 416. Typically, the front top surface 416 will be a horizontal, flat surface when the putter is held upright in an address position. Alternatively, the front top surface 416 can be curved, such that is it convex or concave.

The fiber optic alignment markers 420 and 422 advantageously transmit light to the front top surface 416 of the putter head 402, providing a golfer with an appealing, highly visible alignment marker. The exemplary fiber optic alignment markers 420 and 422 shown in FIG. 4 are two straight fiber optic rods 432 and 434.

As per the alignment markers described above and shown in FIGS. 1-3, the fiber optic markers 420 and 422 will preferably be spaced apart on the front top surface 416 of the putter head 402 such that the centers of the fiber optic markers 420 and 422 as viewed from above align with the diameter of a golf ball. Alternatively, the centers of the fiber optic markers 420 and 422 may align such that the inner or outer edges of the fiber optic markers 420 and 422 align with the diameter of a golf ball. Likewise, the fiber optic alignment markers 420 and 422 will be equidistantly spaced or positioned from the horizontal center of the strike face 408, such that the midpoint of the distance between the markers 420 and 422 on the horizontal front top surface 416 aligns with the horizontal center or sweet spot of the strike face 408.

Figure 5:
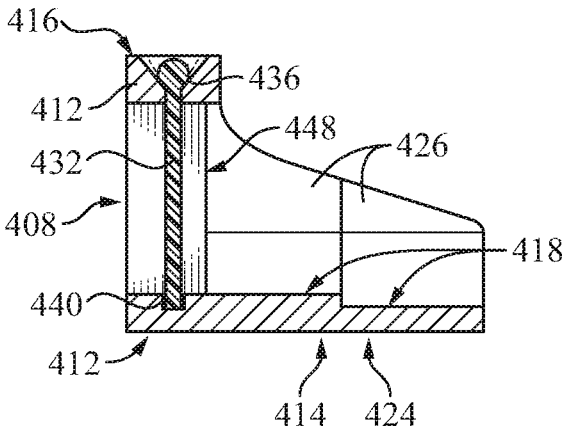
FIG. 5 shows a cut away view of the putter shown in FIG. 4.

FIG. 5 shows a cut away view of the putter head 402, with the cut away portion corresponding with the dotted lines 470 shown in FIG. 4. As seen in FIGS. 4 and 5, the top and bottom of each fiber optic rod 432 and 434 (exemplified by fiber optic rod 432 in FIG. 5) sits within a top receiving member (436, 438) and bottom receiving member (440, 442). As shown in FIG. 5, the top end of fiber optic rod 432 sits in a recessed well or top receiving member 436, while the bottom end of fiber optic rod 432 sits in a recessed well or bottom receiving member 440. While the fiber optic rod

432 can be fixed in place by any number of means, such as a cement, adhesive, or fusing technique, the fiber optic rod 432 is preferably press fit into the top 436 and bottom 440 receiving members. The receiving members 436 and 440 both have channel portions that are configured to be about the width of the fiber optic rod 432, allowing the fiber optic rod 432 to be press fit into the receiving members 436 and 440. In this manner, the fiber optic rods 432 and 434 are removable from their respective top 436, 438 and bottom 440, 442 receiving members. The fiber optic rods 432 and 434 are preferably removable so that they can be replaced if they wear out or become damaged, and can be interchanged with fiber optic rods of different color.

As shown in FIGS. 4 and 5, the ends of fiber optic rods 432 and 434 that emit light may have a circular, ball shaped top or head that faces up to and aligns with the front top surface 416 of the putter head 402. This exemplary shape is shown for purposes of demonstration and does not limit the shape of the light emitting ends of the fiber optic rods 432 and 434. The light emitting ends of the fiber optic rods 432 and 434 alternatively can be cylindrical or formed into alternative shapes that fit into the shape of the receiving members 436 and 438.

The fiber optic rods 432 and 434 transmit captured ambient light to the ends of the fiber optic rods 432 and 434, whereby the ends emit light to provide the alignment markers 420 and 422. As shown in FIG. 5, the representative fiber optic rod 432 is positioned vertically approximately in the center of the front portion 412 of the putter head 402 between the front side (strike face 408) and the rear-facing side 448 of the front portion 412. The ends of the fiber optic rods 432 and 434 therefore align with the midpoint of the width of the front top surface 416. Alternatively, the fiber optic rods 432 and 434 can be positioned closer to either the front edge or back edge of the front top surface 416.

To allow exposure of ambient light to the fiber optic rods 432 and 434, the front portion 412 of the embodiment shown in FIG. 4 has openings or windows 444 and 446 cut into the front portion 412. The openings 444 and 446 lie between the top and bottom receiving members, such that opening 444 is between the top and bottom receiving members 436 and 440, while opening 446 is between the top and bottom receiving members 438 and 442. The openings 444 and 446 can either be on the front side or strike face 408 of the front portion 412, on the rear side 448 of the front portion, or both. Openings 444 and 446 on the strike face 408 allow capture of ambient light from the front side of the putter head 402, while openings 444 and 446 on the backside 448 allow capture of ambient light from the rear side of the putter head 402. Openings 444 and 446 on both the strike face 408 and backside 448 of the front portion 412 of the putter head 402 allow capture of ambient light from the front and rear sides of the putter head 402. The preferred embodiment of the putter head 402 shown in FIG. 4 has openings 444 and 446 in the strike face 408 and rear side 448 of the front portion 412, such that the openings 444 and 446 entirely pass through the front portion 412 of the putter head 402. In this manner, the fiber optic rods 432 and 434 pass through the openings 444 and 446 such that rods 432 and 434 are exposed to a maximal amount of ambient light to help the fiber optic rods 432 and 434 transmit a maximal level of light to their respective ends, and therefore have maximal brightness as alignment markers 420 and 422.

In some alternative instances, the front top surface of a putter may overhang a cavity in the rear portion of the putter. In such instances, the fiber optic rods may be placed through the front top surface of the putter and be exposed to ambient light from the rear of the putter without having an opening cut into the front portion of the putter.

Fiber optics that compose the fiber optic rods 432 and 434 can be chosen to emit any of many different colors of light. Such colors include, but are not limited to, white, yellow, orange, red, blue, green, violet, and virtually any combination of such colors. For example, fiber optic rods 432 and 434 can have a dual color, with an interior color fiber surrounded by a different color fiber, which would appear as concentric circles from above. The Fiber optics for use in the alignment aids 420 and 422 can be made of any appropriate material that will capture ambient light and emit it at the end of the fiber optic. Examples of fiber optics include, but are not limited to, those commercially available as TRUGLO® fibers (TRUGLO Inc.), and optical acrylic rods comprised of fiber having a core of polystyrene containing fluorescent dyes surrounded by a clear acrylic cladding.

The sizes of the diameters of the fiber optic rods 432 and 434 can vary according to desired sizes as well as to those that are commercially available. For example, readily available commercial sizes of fiber optics range in diameter from about 0.5 mm to 2.54 mm. The visible ends of the fiber optic rods 432 and 434 can be formed into different shapes that have similar or larger sizes. For example, a fiber optic having a diameter of 2.54 mm might have a bead type end or head that is larger, such as between 3-6 mm, or 4-5 mm, or larger or smaller, as desired. Moreover, the fiber optic rods 432 and 434 can be composed of one or more individual fibers, allowing the size of the fiber optic rods 432 and 434 to be varied.

Figure 6:
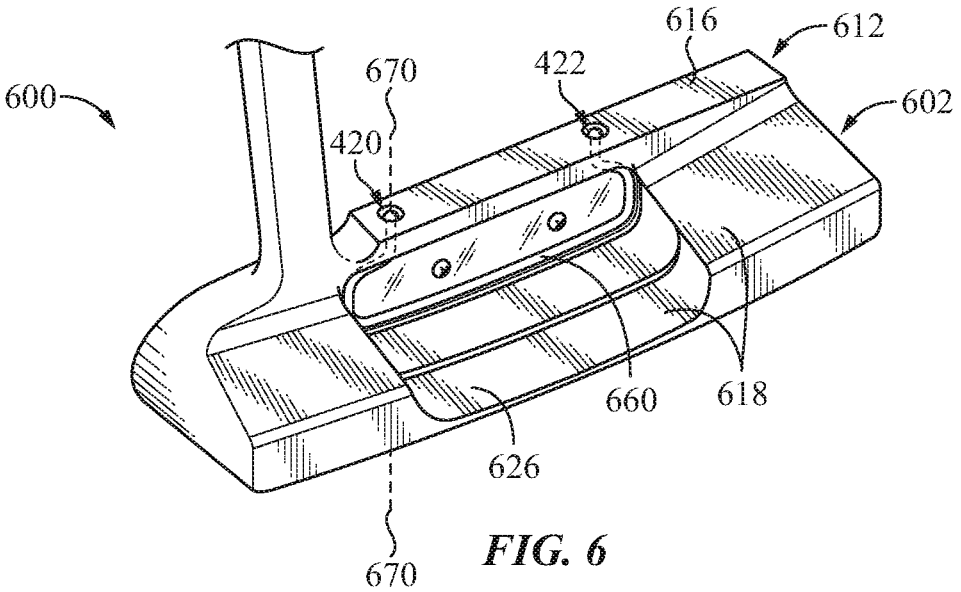
FIG. 6 shows an angled perspective view of the rear of an embodiment of the presently disclosed golf putter alignment system in which the alignment markers are formed from a fiber optic.
Figure 7:
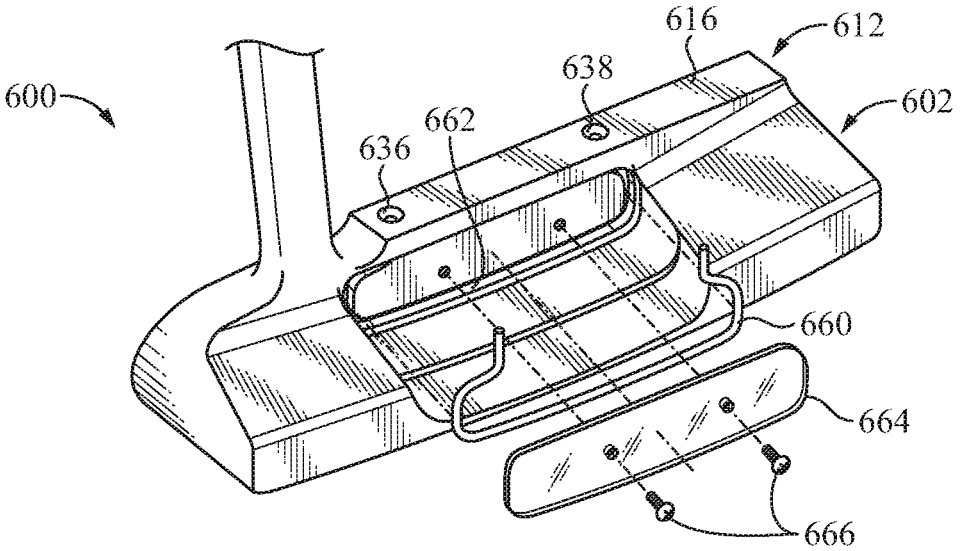
FIG. 7 shows an exploded view of the putter in FIG. 6.
Figure 8:
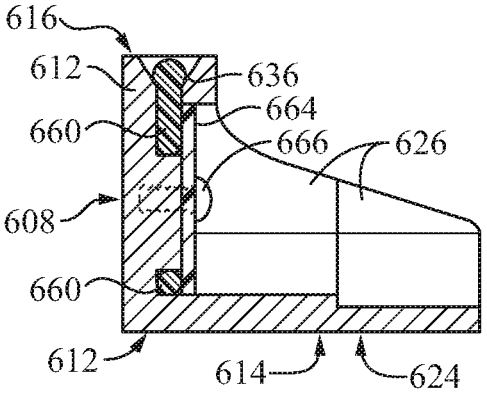
FIG. 8 shows an exploded view of the putter in FIG. 6.

An alternative, preferred embodiment of a putter having fiber optic alignment markers is shown in FIGS. 6, 7, and 8. In this embodiment, the blade putter 600 depicted has an overall structure similar to those of the putters shown in FIGS. 1-5. The fiber optic alignment markers 620 and 622 of the putter head 602 are similar to the fiber optic alignment markers 420 and 422 (described above) with respect to their size and placement on the front top surface 416. Accordingly, the positioning of the fiber optic alignment markers 620 and 622 on the front top surface 616 of putter head 602 corresponds to the positioning of the fiber optic alignment markers 420 and 422 on the front top surface 416 of putter head 402.

The fiber optic alignment markers 620 and 622 of the putter head 602 differ from the alignment markers 420 and 422 of the putter head 402 in that the fiber optic alignment markers 620 and 622 are composed of a single continuous fiber optic 660 rather than individual fiber optic rods, such as shown in FIG. 4 as fiber optic rods 432 and 434 of the putter head 402. As shown in FIGS. 6 and 7, which show the putter head 602 from an angle facing down at the rear of the putter head 602, the fiber optic alignment markers 620 and 622 are the first and second ends of a single fiber optic 660 that is continuous between alignment markers 620 and 622.

The ends of fiber optic 660 of putter head 602 fit into top receiving members 636 and 638. The continuous fiber optic 660 from its first end (alignment marker 620) to its second end (alignment marker 622) runs down from receiving member 636, through a continuous channel 662, and up through receiving member 638. The fiber optic 660 therefore forms a loop through the front portion 612 of the putter head 602, with the ends of the loop held in place by the receiving members 636 and 638, and the central body of the fiber optic loop fit within the channel 662. The channel 662 is positioned on the rear side 648 of the front portion 612 and is open to the rear cavity 626 of the putter head 602. The fiber optic 660 is therefore exposed to ambient light on the rear side 648 of the front portion 612. The ambient light captured by the fiber optic 660 is transmitted to the ends of the fiber optic 660 that are held in the top receiving members 636 and 638. The light emitted from the fiber optic 660 first and second ends is visible from above as alignment markers 620 and 622.

FIG. 7 shows an exploded view of putter head 602. In this exploded view, the channel 662 that fiber optic 660 loops through is readily visible. The shape that fiber optic 660 takes when it is in place within the top receiving members 636, 638 and channel 662 is shown in FIG. 7. The majority of the length of the fiber optic 660 in this configuration is exposed to ambient light, which thereby provides a strong signal of light that is transmitted through the first and second ends of the fiber optic 660. As shown in FIGS. 6 and 7, the portion of the fiber optic 660 that is contained within the channel 662 is held in place by a clear cover 664 that fits over the fiber optic 660 when it is in channel 662. The clear cover 664 is attached to the rear side 648 of the front portion 612 of the putter head by any applicable fastener, such as screws or bolts. In the present embodiment, the clear cover 664 is held in place by screws 666, which screw into threaded holes 668 in the rear side 648 of the front portion 612 of the putter head 602.

The clear cover 664 can be made from any applicable, light transparent material, such as a clear plastic, impact resistant glass, etc.

FIG. 8 shows a cut away view of the putter head 602 depicted in FIGS. 6 and 7, with the cut away portion of the putter corresponding to the dotted lines 670 in FIG. 6. As seen in FIG. 8, the first end of fiber optic 660 resides within a receiving member 636. The very end of the fiber optic 660 has a circular ball structure with a top that is approximately level with the front top surface 616. The end portion of fiber optic 660 is visible as it runs down through the receiving member 636 (into the channel 662, as shown in FIG. 6). The cross-sectional view shows a portion of the fiber optic 660 that runs across the bottom of the channel 662. The fiber optic 660 can be seen held in place in the channel 662 by cover 664 that in turn is held in position by screws 666 that screw into the rear side 648 of the front portion 612 of putter head 612.

The configuration of the removable cover 664 in putter head 602 allows for the fiber optic 660 to be removed from the channel 662 and the receiving members 636 and 638. The fiber optic 660 can therefore be readily removed to be replaced with a new fiber optic should the fiber optic 660 become worn or damaged. Likewise, the fiber optic 660 can be readily removed and replaced by a different fiber optic having a different color.

The exemplary embodiment of a continuous fiber optic 660 in putter head 602 shows a possible configuration for a continuous fiber optic 660 in which the ends of the fiber optic 660 form the two alignment markers 620 and 622. This preferred embodiment provides an example of a configuration for a continuous fiber optic 660, but does not limit or restrict the configuration, such that alternative configurations for a continuous fiber optic fall within the scope of the presently disclosed fiber optic alignment markers.

The above-described exemplary embodiments of the presently disclosed alignment markers depict the alignment markers on a blade style, heel-toe weighted putter. The alignment markers are not limited to this style putter and may be used on virtually any style of putter, including blades, mallets, T-shaped putters, and so on.

While the present invention has been described as having configurations disclosed herein, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

I claim:

1. A putter head comprising:

a front portion having a forward facing vertical ball striking face and an upward facing front top surface adjacent to the vertical striking face;

a rear portion that extends away the front portion, and an upward facing rear top surface;

a first alignment circle and a second alignment circle mounted on the front top surface, the first and second alignment circles formed in one or more colors that contrast with the color of the front top surface, wherein the first and second alignment circles are located toward opposite ends of the front top surface;

wherein each of the first and second alignment circles are equidistantly located from a midpoint in the front top surface that aligns with the horizontal center of the strike face; and wherein no alignment markers are present at the midpoint.

2. The putter head of claim 1, wherein the distance between the centers of the alignment circles corresponds to a golf ball diameter, the diameter of the golf ball being approximately 1.680 inches.

3. The putter head of claim 2, wherein the first and second alignment circles comprise a first and second light emitting member integrally formed with the front portion, the front portion having two or more receiving members, wherein one or more receiving members receives and holds the first light emitting member, and one or more receiving members receives and holds the second light emitting member, each light emitting member comprising a light capturing surface and a light emitting surface;

wherein the light capturing surface is exposed to ambient light; and wherein the light emitting surface faces upward from the front top surface.

4. The putter head of claim 3, wherein the light emitting member of each of the first and second alignment circles comprises fiber optic material.

5. The putter head of claim 4, wherein each of the first and second alignment circle fiber optics is removable.

6. The putter head of claim 4, wherein each of the first and second alignment circles is a separate fiber optic positioned vertically within the front portion, the front portion having a first top receiving member and first bottom receiving member for the first fiber optic alignment marker and a second top receiving member and second bottom receiving member for the second fiber optic alignment marker;

wherein the front portion has a first opening through the front portion between the first top and bottom receiving members, a second opening through the front portion between the second top and bottom receiving members; and wherein the light capturing surface of the first fiber optic passes through the first opening and the light capturing surface of the second fiber optic passes through the second opening.

7. The putter head of claim 4, wherein each of the first and second alignment circles is formed from a first emitting end and a second emitting end of a continuous fiber optic, wherein the first emitting end is positioned within a first top receiving member and the second emitting end is positioned within a second top receiving member; and wherein the fiber optic passes through the first and second top receiving members to an open bottom receiving member on the rear facing side of the front portion, the open bottom receiving member receiving the light capturing surface of the fiber optic to expose the light capturing surface to ambient light.

8. The putter head of claim 7, wherein the bottom receiving member is an open channel through which the light capturing surface of the fiber optic is positioned and exposed to ambient light; and wherein a clear cover is positioned over the bottom receiving member and light capturing surface, and the clear cover is held in place by one or more removable fasteners.

9. The putter head of claim 1, wherein the distance between the inner edges of the alignment circles corresponds to a golf ball diameter, the diameter of the golf ball being approximately 1.680 inches.

10. The putter head of claim 1, wherein the distance between the outer edges of the alignment circles corresponds to a golf ball diameter, the diameter of the golf ball being approximately 1.680 inches.

11. The putter head of claim 1, wherein each of the alignment circles is removable.

12. The putter head of claim 1, wherein each of the first and second alignment circles is integrally formed as part of the front portion, wherein each of the first and second alignment circles is held in a receiving member within the front portion; and wherein each of the tops of the first and second alignment circles are level with the front top surface.

13. The putter head of claim 1, wherein each of the first and second alignment circles is integrally formed as part of the front portion, wherein each of the first and second alignment circles is held in a receiving member within the front portion; and wherein each of the tops of the first and second alignment circles are recessed below the front top surface.

14. The putter head of claim 1, wherein each of the first and second alignment circles is integrally formed as part of the front portion, wherein each of the first and second alignment circles is held in a receiving member within the front portion; and wherein each of the tops of the first and second alignment circles extend above the front top surface.

15. The putter head of claim 1, wherein the first and second alignment circles have a same size diameter.

16. The putter head of claim 15, wherein the alignment circles each comprise an inner circle that is concentric with an outer circle, wherein the inner circle and outer circle each have a different, contrasting color.

17. The putter head of claim 1, wherein each of the alignment circles is made of a light reflecting material.

18. The putter head of claim 1, wherein each of the alignment circles is made of a light emitting material.

19. A putter head comprising:

a front portion having a forward facing vertical ball striking face and an upward facing front top surface adjacent to the vertical striking face, the front top surface having a front facing edge and a rear facing edge;

a rear portion that extends away the front portion, and an upward facing rear top surface;

a first circular alignment marker and a second circular alignment marker mounted on the front top surface, the first and second circular alignment markers having equal sized diameters;

the first and second circular alignment markers formed in one or more colors that contrast with the color of the front top surface;

wherein the first and second circular alignment markers are located toward opposite ends of the front top surface;

wherein each of the first and second alignment markers are equidistantly located from a midpoint in the front top surface that aligns with the horizontal center of the strike face;

wherein the distance between the centers of the first and second circular alignment markers corresponds to a golf ball diameter, the diameter of the golf ball being approximately 1.680 inches;

wherein the centers of the first and second circular alignment markers further align with the midpoint of the front top surface between the front and rear facing edges of the front top surface; and wherein no alignment markers are present at the midpoint.

20. A putter head comprising:

a front portion having a forward-facing vertical ball striking face and an upward facing front top surface adjacent to the vertical striking face, the front top surface having a front facing edge and a rear facing edge;

first and second circular alignment markers comprising a fiber optic integrally formed with the front portion, the front portion having two or more receiving members, each receiving member for receiving the first or second fiber optic;

each fiber optic comprising a light emitting end having a light emitting surface and a light capturing surface;

wherein the light emitting end of each fiber optic is positioned in a receiving member and is located through the upward front top surface, with the light emitting surface facing upward from the top front surface;

wherein the light capturing surface of the fiber optic passes through an open space to a bottom receiving member, exposing the light capturing surface to ambient light;

wherein each of the first and second fiber optic light emitting end surfaces are equidistantly located from a midpoint in the front top surface that aligns with the horizontal center of the strike face;

wherein the distance between the centers of the first and second fiber optic light emitting end surfaces corresponds to a golf ball diameter, the diameter of the golf ball being approximately 1.680 inches;

wherein the centers of the first and second fiber optic light emitting end surfaces further align with the midpoint of the front top surface between the front and rear facing edges of the front top surface; and wherein no alignment markers are present at the midpoint.

* * * * *